US009250041B2

(12) United States Patent
Howland et al.

(10) Patent No.: US 9,250,041 B2
(45) Date of Patent: Feb. 2, 2016

(54) SHAPABLE ARMOR FOR USERS

(71) Applicant: Warwick Mills Inc., New Ipswich, NH (US)

(72) Inventors: Charles A. Howland, Temple, NH (US); Virginia Houston Howland, Temple, NH (US)

(73) Assignee: WARWICK MILLS INC., New Ipswich, NH (US)

( * ) Notice: Subject to any disclaimer, the term of this patent is extended or adjusted under 35 U.S.C. 154(b) by 0 days.

(21) Appl. No.: 14/497,981

(22) Filed: Sep. 26, 2014

(65) Prior Publication Data

US 2015/0082507 A1 Mar. 26, 2015

Related U.S. Application Data

(60) Provisional application No. 61/882,817, filed on Sep. 26, 2013.

(51) Int. Cl.

| | |
|---|---|
| ***A41D 13/00*** | (2006.01) |
| ***F41H 1/02*** | (2006.01) |
| ***F41H 1/00*** | (2006.01) |
| ***A41D 19/015*** | (2006.01) |
| *A41D 1/04* | (2006.01) |

(52) U.S. Cl.

CPC ..... *F41H 1/02* (2013.01); *A41D 13/0012* (2013.01); *A41D 19/01505* (2013.01); *F41H 1/00* (2013.01)

(58) Field of Classification Search

CPC ..... F41H 1/02; F41H 5/0485; F41H 1/00; A45F 3/06; A41D 1/04; A41D 13/0518; A41D 13/0012; A41D 19/01505; A41D 19/001; A41D 27/00; A41D 31/0061; Y10S 2/913; Y10S 428/911

See application file for complete search history.

(56) References Cited

U.S. PATENT DOCUMENTS

| | | | | | |
|---|---|---|---|---|---|
| 2,113,779 | A | * | 4/1938 | Williamson | 128/201.27 |
| 2,790,973 | A | * | 5/1957 | Lewis, Jr. et al. | 2/2.5 |
| 3,963,022 | A | * | 6/1976 | Rotello | 602/70 |
| 3,991,421 | A | * | 11/1976 | Stratten | 2/2.5 |
| 4,231,119 | A | * | 11/1980 | Quinn | 2/48 |
| 4,467,476 | A | * | 8/1984 | Herbert | 2/2.5 |
| 4,578,824 | A | * | 4/1986 | Waldron | 2/96 |
| 4,774,726 | A | * | 10/1988 | Garrett | 2/105 |
| 5,237,704 | A | * | 8/1993 | Phippen | 2/45 |
| 5,315,712 | A | * | 5/1994 | McTaggart | 2/106 |
| 5,579,540 | A | * | 12/1996 | Walker | 2/209.11 |
| 5,617,582 | A | * | 4/1997 | Burwell | 2/102 |
| 5,718,000 | A | * | 2/1998 | Ost et al. | 2/69 |
| 5,978,961 | A | * | 11/1999 | Barker | 2/2.5 |

(Continued)

*Primary Examiner* — Bobby Muromoto, Jr.

(74) *Attorney, Agent, or Firm* — Maine Cernota & Rardin

(57) ABSTRACT

A carrier garment configured to carry protective panels on a user's torso allows adjustment of the carrier garment and the protective panels to accommodate a wide range of bust and torso sizes, from flat-chested to full figured bust and torso lines. Embodiments allow quick adjustment back to a flat configuration to accommodate rifle protection plates that require the carrier and the underlying panels to be flat. Various embodiments can be locked to ensure that the garment retains its adjusted shape. A shaping point and/or a slit can be provided to assist in shaping stiff materials. Embodiments include a plurality of attachment points to which a lower end of an adjustment lanyard can be attached. A lining or inner layer can be included, and can be configured to adjust in shape with the outer garment. The outer garment and/or the liner or inner layer can include a protective material.

33 Claims, 19 Drawing Sheets

(56) References Cited

U.S. PATENT DOCUMENTS

| | | | | |
|---|---|---|---|---|
| 6,098,196 | A * | 8/2000 | Logan | 2/2.5 |
| 6,210,352 | B1 * | 4/2001 | Williams et al. | 602/3 |
| 6,308,342 | B1 * | 10/2001 | Qi | 2/403 |
| 6,374,418 | B1 * | 4/2002 | Rindle | 2/202 |
| 7,114,188 | B1 * | 10/2006 | Teigen | 2/24 |
| 7,257,846 | B2 * | 8/2007 | Paciorkowski | 2/267 |
| 7,458,491 | B2 * | 12/2008 | Cragg | 224/648 |
| 7,517,273 | B2 * | 4/2009 | Wooten | 450/63 |
| 8,133,241 | B2 * | 3/2012 | Boyd et al. | 606/151 |
| 8,152,593 | B2 * | 4/2012 | Barton et al. | 450/88 |
| 8,166,571 | B2 * | 5/2012 | Fletcher | 2/48 |
| 8,418,265 | B1 * | 4/2013 | Storms et al. | 2/102 |
| 8,516,620 | B1 * | 8/2013 | Kalaam et al. | 2/238 |
| 8,595,862 | B2 * | 12/2013 | Storms et al. | 2/2.5 |
| 8,714,425 | B2 * | 5/2014 | Meyer et al. | 224/643 |
| 8,807,411 | B2 * | 8/2014 | Meyer | 224/627 |
| 2001/0029621 | A1 * | 10/2001 | Howland et al. | 2/2.5 |
| 2002/0124808 | A1 * | 9/2002 | Zampelli et al. | 119/497 |
| 2003/0028971 | A1 * | 2/2003 | Chaffee | 5/706 |
| 2004/0157514 | A1 * | 8/2004 | Courtney | 441/88 |
| 2004/0159691 | A1 * | 8/2004 | Dingman et al. | 224/656 |
| 2004/0245304 | A1 * | 12/2004 | Cragg | 224/648 |
| 2005/0130558 | A1 * | 6/2005 | Wooten | 450/39 |
| 2010/0009598 | A1 * | 1/2010 | Barton et al. | 450/39 |
| 2010/0088795 | A1 * | 4/2010 | Simione | 2/24 |
| 2010/0205708 | A1 * | 8/2010 | Storms et al. | 2/2.5 |
| 2010/0229273 | A1 * | 9/2010 | Crye | 2/2.5 |
| 2010/0287681 | A1 * | 11/2010 | Storms et al. | 2/102 |
| 2011/0023207 | A1 * | 2/2011 | Storms et al. | 2/102 |
| 2011/0113520 | A1 * | 5/2011 | Dennis | 2/2.5 |
| 2011/0120295 | A1 * | 5/2011 | Carter | 89/36.05 |
| 2011/0154552 | A1 * | 6/2011 | Fletcher | 2/48 |
| 2011/0160022 | A1 * | 6/2011 | Sato | 482/113 |
| 2011/0278338 | A1 * | 11/2011 | Darnell et al. | 224/637 |
| 2012/0266344 | A1 * | 10/2012 | Griffin | 2/2.5 |
| 2012/0289106 | A1 * | 11/2012 | Kent | 441/119 |
| 2012/0297527 | A1 * | 11/2012 | Darnell et al. | 2/455 |
| 2012/0304355 | A1 * | 12/2012 | Dennis | 2/2.5 |
| 2012/0318837 | A1 * | 12/2012 | Yaeger et al. | 224/665 |
| 2012/0324612 | A1 * | 12/2012 | Howell et al. | 2/2.5 |
| 2013/0048691 | A1 * | 2/2013 | Meyer et al. | 224/579 |
| 2013/0139294 | A1 * | 6/2013 | Zetune et al. | 2/163 |
| 2013/0221049 | A1 * | 8/2013 | Giard et al. | 224/604 |
| 2013/0232652 | A1 * | 9/2013 | Kalaam et al. | 2/2.5 |
| 2014/0096305 | A1 * | 4/2014 | Friesen | 2/84 |
| 2014/0216874 | A1 * | 8/2014 | Farrelly et al. | 190/109 |
| 2014/0305982 | A1 * | 10/2014 | Pelland et al. | 224/576 |
| 2014/0338095 | A1 * | 11/2014 | Storms et al. | 2/102 |
| 2015/0141892 | A1 * | 5/2015 | Ingimundarson et al. | 602/19 |

* cited by examiner

Back and Front Contours

Girth Measurement Locations, Female and Male

SHAPABLE ARMOR FOR USERS

RELATED APPLICATIONS

This application claims the benefit of U.S. Provisional Application No. 61/882,817, filed Sep. 26, 2013, which is herein incorporated by reference in its entirety for all purposes.

FIELD OF THE INVENTION

The invention relates to a garment that can support body armor, and more particularly to a garment worn on the torso that supports body armor.

BACKGROUND OF THE INVENTION

Under existing body armor designs, both female and male torso armor are designed and tested as flat panels. It would be preferable for armor to conform to the user's body shape, to improve its comfort and concealability among other advantages. Some designs exist which provide 3-dimensional shapes for female torsos. However, those few female body armor designs which provide shaping to accommodate the female bust require special manufacturing molds, adding expense to the product and to the performance testing. In addition, these special manufacturing molds do not address male torsos, which can vary in shape due to differing degrees of user muscle mass.

Some body armor designs include a plurality of penetrator-resistant panels inserted into pockets or otherwise attached to a carrier garment worn on the torso. However, such carrier garments are typically not fitted to the varying torso shapes of different users, including female bust lines and male pectoral shapes, since such shaping would require that the carrier garments be specially produced. As a result, the comfort and concealability of this type of armor also suffers due to poor conformance of the shape to the user.

For most military and commercial applications, custom carrier garments are not a viable option. Even if a plurality of different standard sizes and shapes were produced, it would be necessary to provide hundreds of different size and shape options to provide good conformance and concealability, which renders this approach almost as difficult and impractical as custom fitting.

What is needed, therefore, is a torso armor carrier that can be adjusted to accommodate varying torso shapes without requiring special manufacturing, custom manufacture, or manufacture of hundreds of different size and shape options.

SUMMARY OF THE INVENTION

The present invention relates to armor intended for protecting a user from ballistic and/or stab threats. More specifically, the invention is a carrier garment configured to carry protective panels on a user's torso, where the carrier garment and the protective panels can be adjusted in shape as needed to accommodate a wide range of female and male torso sizes and types, from flat-chested torsos to highly-muscled chests or full-figured bust lines. Embodiments of the claimed carrier garment also allow subsequent readjustment to a different shape, and/or quick readjustment to a flat configuration to accommodate rifle protection plates that require the carrier and the underlying panels to lay flat during use as well as during testing.

In embodiments, the shape adjustment of the present invention is realized by including at least one lanyard extending downwards from each shoulder that can be adjusted in length as well as in anterior/posterior attachment location. Shaping points can be provided, for example loops attached to the carrier garment through which the lanyard passes to apply a shaping force to a designated location on the garment. Some embodiments also include one or more slits, which can improve the range of shape adjustment and the ability to adjust the shape for garments made from a stiff material.

One general aspect of the present invention is a torso garment including an outer torso garment having two shoulders and a front section, said front section including an upper front torso region, a controllable shape adjustment mechanism located in the upper front torso region of the outer torso garment, said shape adjustment mechanism being able to transition a shape of the outer torso garment from a substantially flat configuration to a three-dimensionally shaped configuration, and an inner layer included within the outer torso garment, wherein said inner layer is adjusted in shape together with the outer torso layer.

Embodiments further include an anterior garment edge comprising at least one shaping point.

In some embodiments, the adjustment mechanism includes an adjustment lanyard having an attachment point proximal to a shoulder of the outer torso garment. In some of these embodiments a lower attachment point of the adjustment lanyard can be moved in an anterior/posterior direction between a plurality of attachment locations on the outer torso garment. Other of these embodiments further include a shaping point attached to the outer torso garment, said shaping point being configured to require the adjustment lanyard apply force to a location that is cooperative with the shaping point. In various of these embodiments, the adjustment lanyard can be readjusted to transition the shape of the torso garment from the three-dimensionally shaped configuration into the substantially flat configuration. And in certain of these embodiments the adjustment lanyard is located on an inwardly facing side of the outer torso garment.

Embodiments further include a locking mechanism that is able to inhibit changes to the shape of the outer torso garment. Some embodiments further include at least one slit extending along a portion of an anterior garment edge of the torso garment.

In various embodiments, at least a portion of the torso garment comprises a material that is at least one of flame resistant and constructed from fibers that are greater than 15 gpd.

In certain embodiments the torso garment has a three-dimensional shape arising from its pattern and sewing design. And in some embodiments the outer torso garment further comprises inner pockets configured for holding and concealing body armor modules.

Another general aspect of the present invention is a torso garment having a controllable shape adjustment that can be used to adjust a fullness of an upper front torso region of the torso garment. The torso garment includes an outer torso garment having two shoulders and a front section, said front section including an upper front torso region, and a controllable shape adjustment mechanism located in the upper front torso region of the outer torso garment, said shape adjustment mechanism being able to transition a shape of the outer torso garment from a substantially flat configuration to a three-dimensionally shaped configuration having a fullness ratio of greater than 0.1 in the torso when measured along a sagittal mid-plane of the outer torso garment, said shaping mechanism comprising an adjustment lanyard.

In embodiments, the adjustment lanyard includes at least one attachment point proximal to a shoulder of the outer torso garment. Some embodiments further include an anterior garment edge comprising at least one shaping point.

In various embodiment, the adjustment mechanism is able to transition the shape of the outer torso garment to a three-dimensionally shaped configuration having a fullness ratio of greater than 0.5 in the torso when measured along a sagittal mid-plane of the outer torso garment.

In certain embodiments, a lower attachment point of the adjustment lanyard can be moved in an anterior/interior direction between a plurality of attachment locations on the outer torso garment.

In some embodiments, the adjustment lanyard is located on an inwardly facing side of the outer torso garment. Other embodiments further include a locking mechanism that is able to inhibit changes to the shape of the outer torso garment.

In various embodiments, the adjustment lanyard can be readjusted to transition the shape of the torso garment from the three-dimensionally shaped configuration into the substantially flat configuration.

Certain embodiments further include at least one slit extending along a portion of an anterior garment edge of the torso garment. In exemplary embodiments, at least a portion of the torso garment comprises a material that is at least one of flame resistant and constructed from fibers that are greater than 15 gpd.

In some embodiments, the torso garment has a three-dimensional shape arising from its pattern and sewing design. An in other embodiments the outer torso garment further comprises inner pockets configured for holding and concealing body armor modules.

Yet another general aspect of the present invention is a method for adjusting a shape of a torso garment. The method includes providing a torso garment, and using an adjustment mechanism to transition a shape of the torso garment from a substantially flat configuration to a three dimensional shaped configuration by applying a force to at least two adjustment locations on the torso garment, said two adjustment locations being selected from the group of locations including a first location proximal to an anterior armpit of the outer torso garment, a second location proximal to a midpoint frontal plane of the torso garment and to an under bust girth of the torso garment, and a third location located between the first location and the second location.

In embodiments, the torso garment comprises an anterior garment edge that includes at least one shaping point.

In some embodiments, the adjustment mechanism includes an adjustment lanyard having an attachment point proximal to a shoulder of the torso garment. In some of these embodiments a lower attachment point of the adjustment lanyard can be moved in an anterior/posterior direction between a plurality of attachment locations on the torso garment. Other of these embodiments further include using a locking mechanism to inhibit changes to the shape of the outer torso garment. In certain of these embodiments the adjustment lanyard is located on an inwardly facing side of the torso garment. Some of these embodiments further include readjusting the adjustment lanyard to transition the shape of the torso garment from the three-dimensionally shaped configuration to the substantially flat configuration. And in other of these embodiments the torso garment further comprises a shaping point attached thereto, said shaping point being configured to require the adjustment lanyard to apply force to a location that is cooperative with the shaping point.

In embodiments, the torso garment further comprises at least one slit extending along a portion of an anterior garment edge of the torso garment.

In some embodiments, n at least a portion of the torso garment comprises a material that is at least one of flame resistant and constructed from fibers that are greater than 15 gpd. In other embodiments, the torso garment has a three-dimensional shape arising from its pattern and sewing design.

And in certain embodiments, the torso garment further comprises inner pockets configured for holding and concealing body armor modules.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 3:
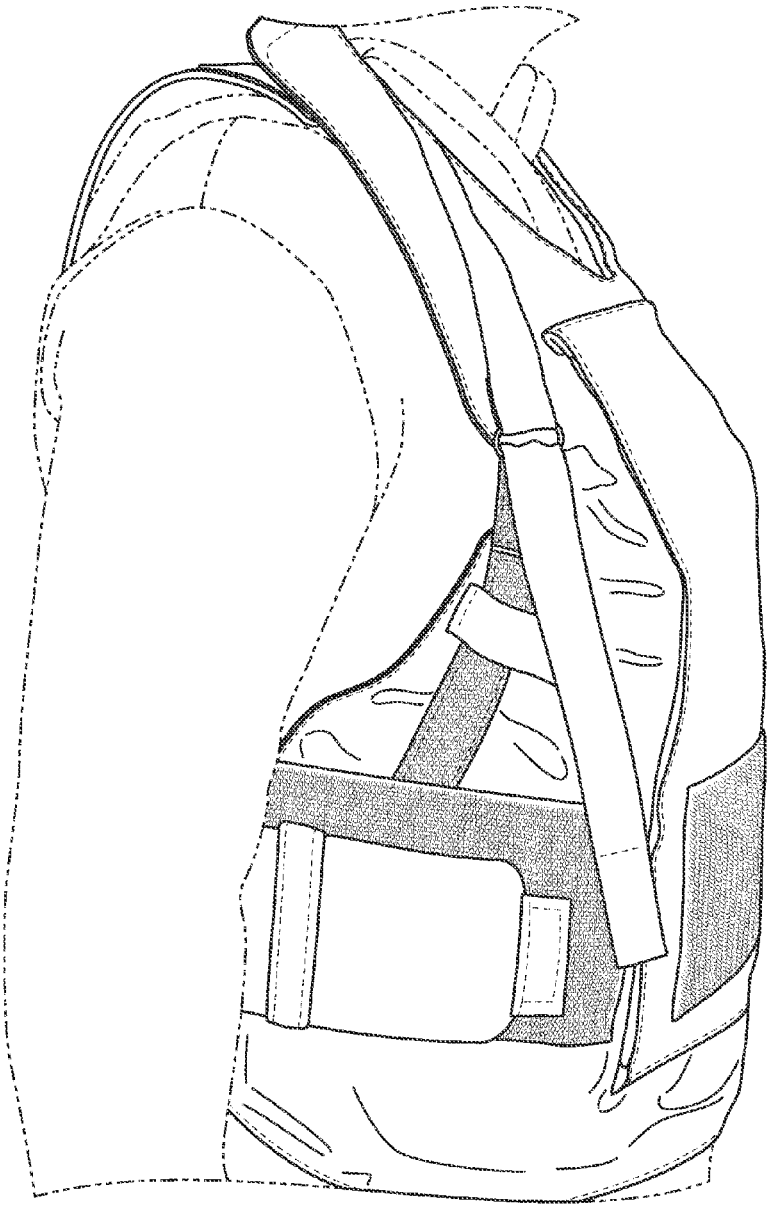
FIG. 3 is a side illustration of a user wearing an embodiment of the present invention shown in a modestly shaped configuration.
Figure 7:
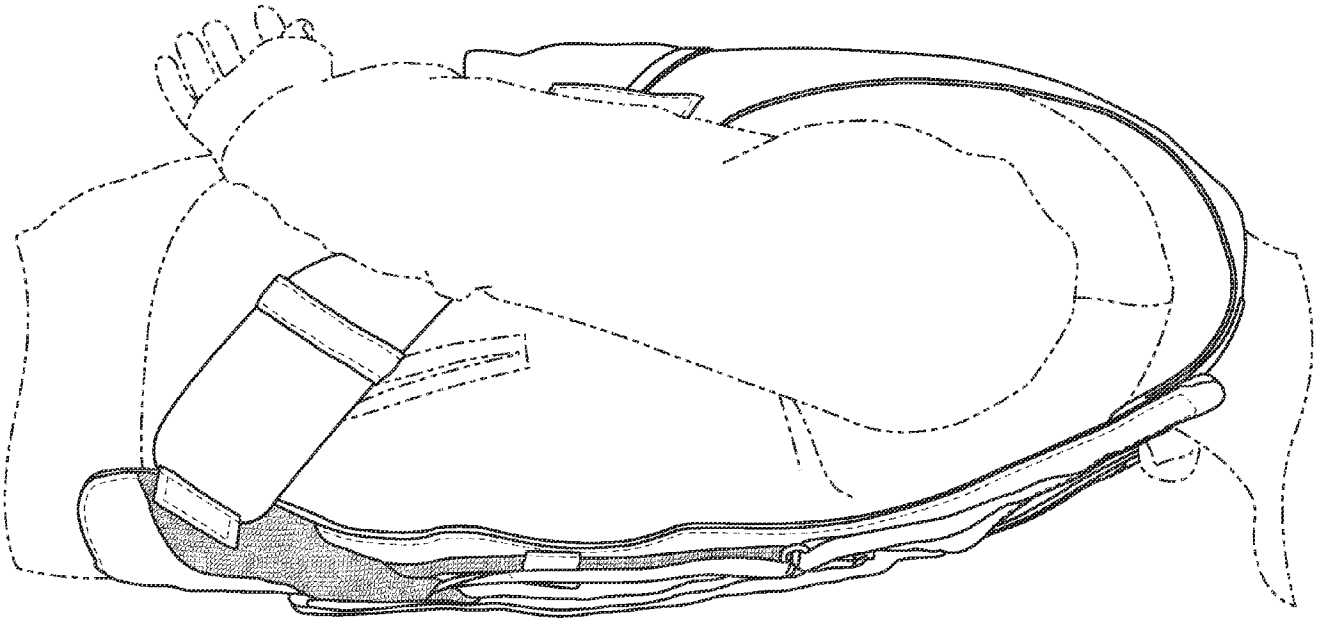
FIG. 7 is a side view of the embodiment of FIG. 4, shown after the adjustment has been reversed and the shaping has been removed.
Figure 8:
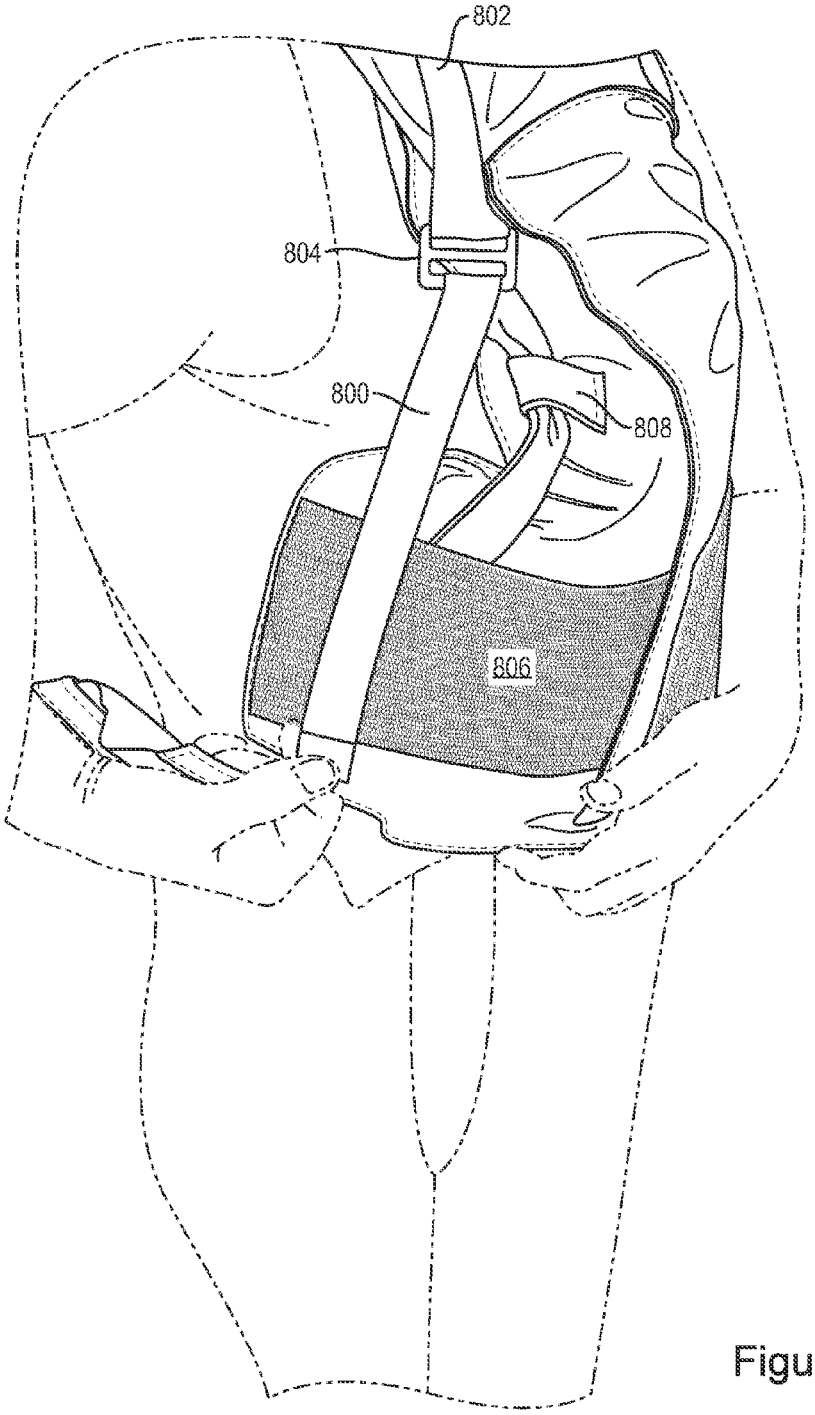
FIG. 8 is a perspective view of a user adjusting an adjustment lanyard having a plurality of lower attachment points in an embodiment of the invention.
Figure 9:
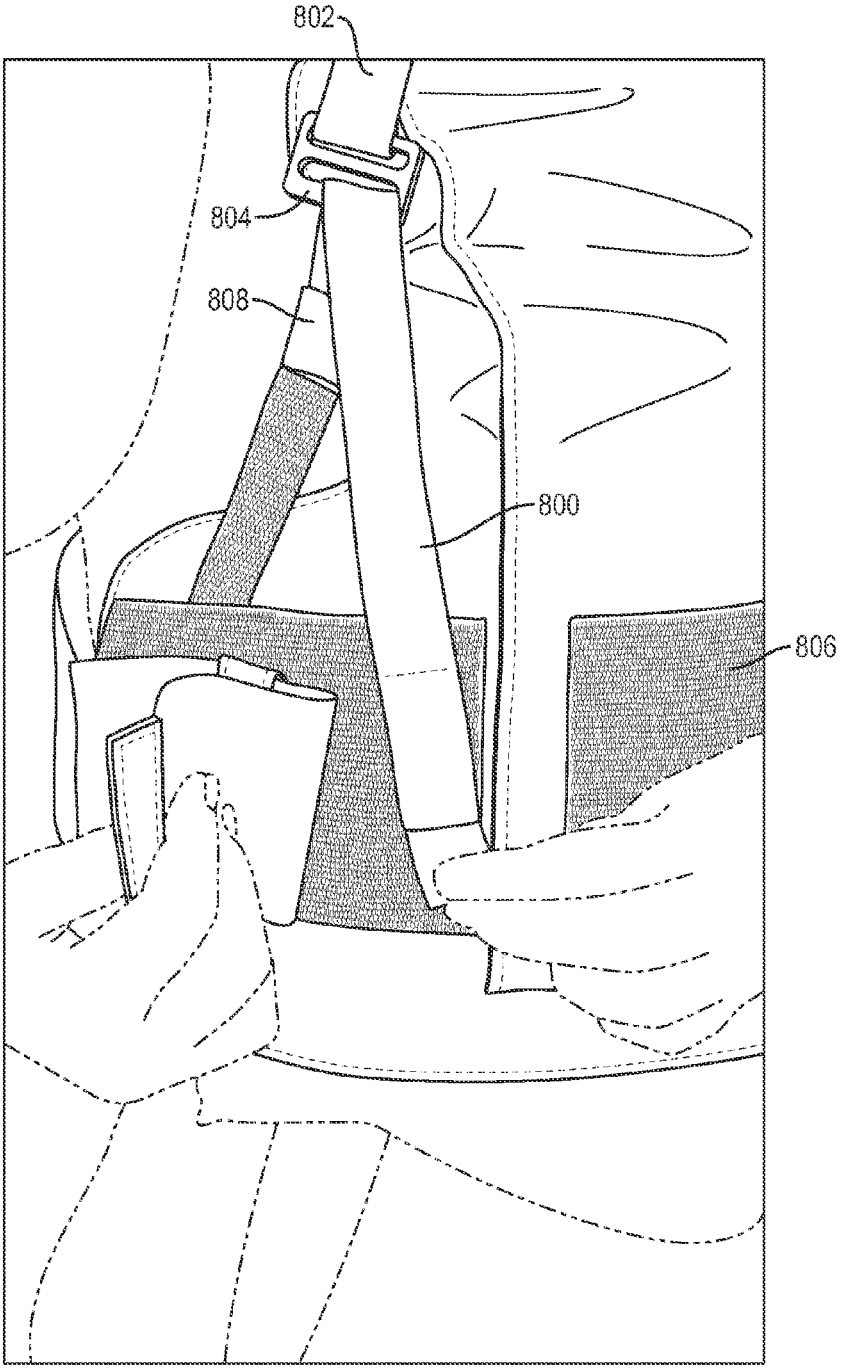
FIG. 9 is a perspective view of the embodiment of FIG. 8, showing the lanyard being moved to a different lower attachment point.
Figure 10:
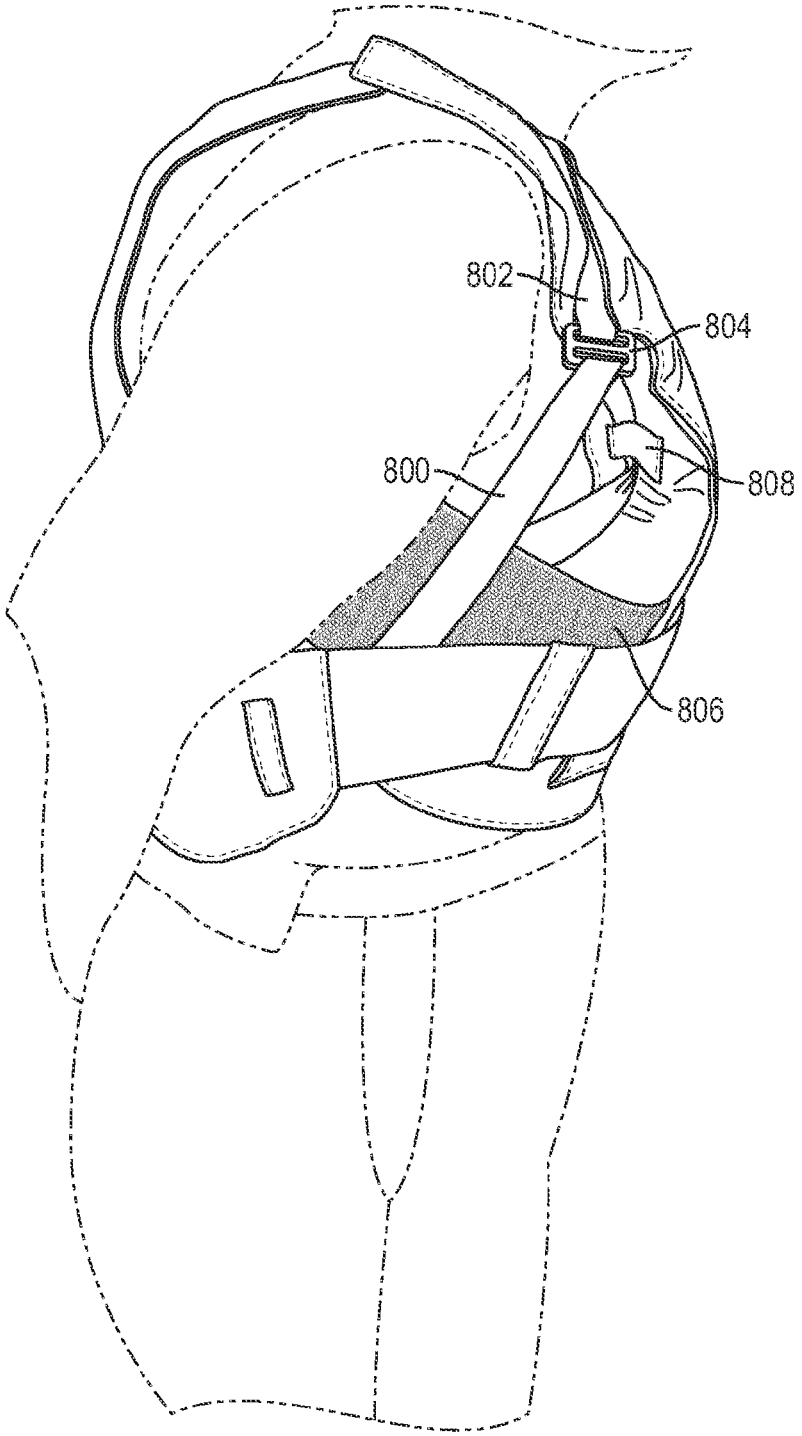
FIG. 10 is a side view of the embodiment of FIG. 8.
Figure 11:
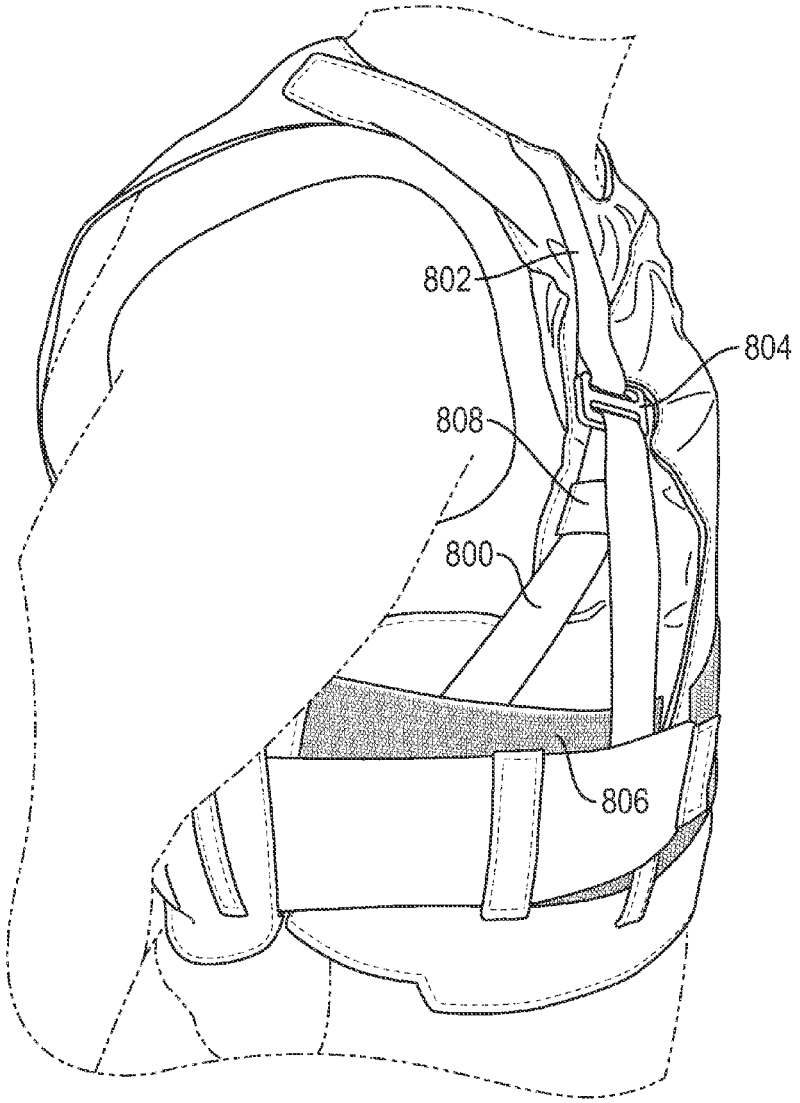
FIG. 11 is a side view of the embodiment of FIG. 9.

With reference to FIGS. 1-7, the present invention is a carrier garment configured to carry protective panels on a user's torso, where the carrier garment and the protective panels can be adjusted and in embodiments further readjusted to accommodate a wide range of chest sizes and shapes, from flat-chested torsos (FIGS. 1 and 2) to highly curved chests (FIGS. 4-6), as well as shapes between the two extremes (FIG. 3). The carrier garment also allows quick adjustment back to a flat configuration to accommodate rifle protection plates that require the carrier and the underlying panels to be flat (FIG. 7).

In some embodiments, the carrier garment of the present invention covers the entire front, sides and back of a user's torso from neck to waist, while in other embodiments the garment only covers a subset of the torso area as desired. The garment can include a single panel that covers the front and back of the torso with an opening for the head and arms, or it can comprise multiple panels that cover all or only part of the torso. The garment can be made from any suitable textile material, woven, knit, or non-woven. In some embodiments, the garment material is polycotton. In other embodiments, the garment includes fabric that is resistant to flame, ballistic threats, blunt trauma threats, and/or stab threats, so that the garment can be worn as a ballistic or protective pack.

The garment of the present invention features a controlled shape adjustment to adjust the fullness of the garment in the upper torso. The controlled shape adjustment allows the garment to increase in fullness or to decrease in fullness in the torso area, depending on user preferences. In embodiments, this shape adjustment can alter the garment's upper torso profile from 0 to 8 inches in shape fullness, with zero inches having no shape and 8 inches having the most shape. In some embodiments the garment's upper torso adjustment can differ from side to side, with one side having more or less adjustment than the other side.

Figure 12:
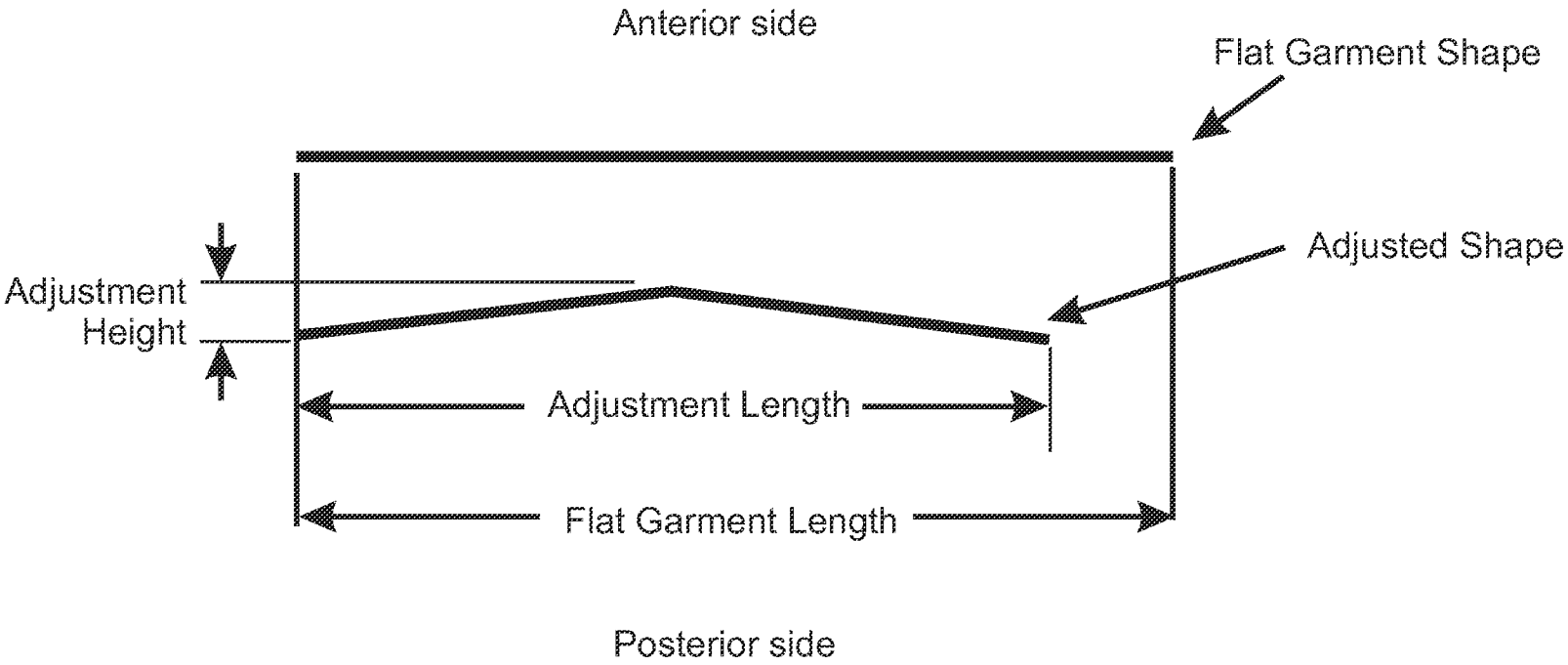
FIG. 12 is a diagram detailing the fullness ratio dimensions and locations of an embodiment of the invention.

With reference to FIG. 12, the garment's fullness ratio is defined as the ratio between the vertical distance from a flat plane ("adjustment height in FIG. 12) and the decrease in garment length ("flat garment length"—"adjusted garment length" in FIG. 12) when the garment shaping has been adjusted.

Figure 13:
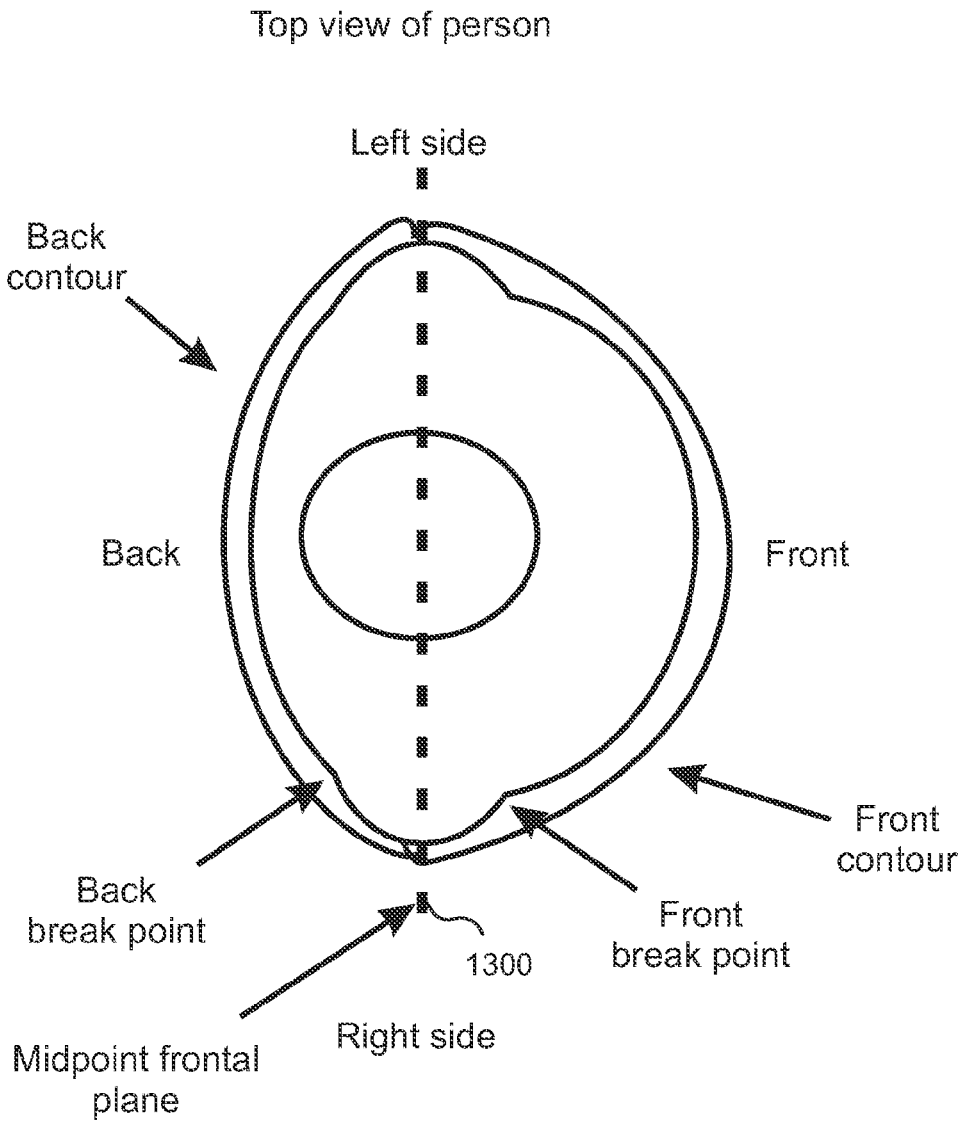
FIG. 13 is drawing from above detailing the midpoint frontal plane of a user of an embodiment of the invention.

With reference to FIG. 13, the midpoint frontal plane is defined as a plane 1300 bisecting the torso halfway between the front break-point and the back break-point on the torso sides, where the front break-point is the location on the front of the torso where the arm separates from the torso, and the back break-point is the location on the back of the torso where the arm separates from the torso, as shown in the Figure.

Figure 14:
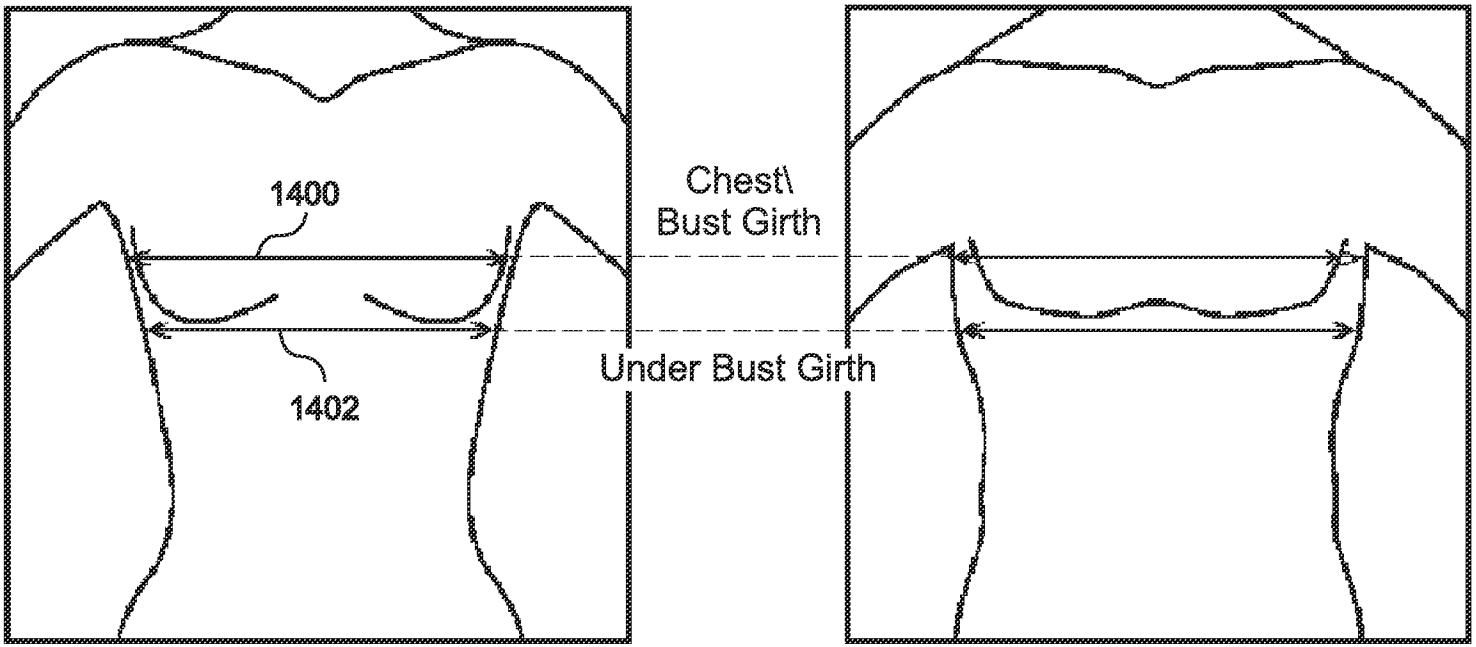
FIG. 14 is a drawing of a male and female torso detailing the under bust girth locations according to an embodiment of the invention.

With reference to FIG. 14, the under bust girth locations are defined as the horizontal circumference around the torso under the arms 1400 and under the bust 1402 (ASTM D5219).

With reference to FIGS. 8-11, in embodiments the garment of the present invention features an adjustable lanyard 800 with at least one attachment point at a shoulder to make the fullness in the upper front torso easier to shape. In the embodiment of FIGS. 8-11, the attachment to the shoulder is by a fixed-length "lanyard top" 802 terminating in a D-ring 804. In the embodiment of FIGS. 8-11, the adjustable lanyard 800 is fixed at one end to a band 806 attached to the carrier garment below the bust, and is adjustably attachable to the same band 806 by hook-and-loop attachment at its other end. The lanyard 800 also passes through a shaping point 808 attached to the garment between the D-ring 804 and the band 806. In this embodiment, the shaping point is a loop attached to the garment, similar to a belt loop. In general, a shaping point is defined herein as any mechanism attached to the garment that allows the lanyard 800 to travel through it, thereby providing a point of applied force and bending to the adjusted garment.

The embodiment of FIGS. 8-11 allows the user to make small, incremental changes to the fullness shape of the carrier simply by adjusting the hook-and-loop attachment location of the lanyard 800 to the band 806, so as to re-shape the chest-area of the carrier to match the user's shape.

In embodiments, various attachment mechanisms of the lanyard 800 are used, such as hook-and-loop (as shown in the figures), snaps, hook and eye, zippers, and eyelets. In some of these embodiments, including the embodiment illustrated by FIGS. 8-11, the lower attachment point of the adjustable lanyard is adjustable in an anterior to posterior direction. This allows a flatter, smaller adjustment when the lanyard is attached to the posterior, or to a location near the center front, and allows a much larger adjustment of the full 8 inch depth shape (see FIG. 6) by attaching the end of the lanyard 800 to the anterior, side, or back. Accordingly, because the adjustable lanyard 800 in these embodiments is attachable at its lower end to various locations along the mid torso, from the front to the back of the garment, the user has greater latitude for fine-tuning how much shaping, if any, is applied. In embodiments, the user can adjust the shaping to accommodate use scenarios. For example, the garment can be adjusted to tight conformal shaping for high physical activity or to a flatter configuration with little or no shaping for rest and greater air circulation.

Other embodiments include an anterior garment edge comprising at least one shaping point about which the garment will preferentially bend. This shaping point helps to define where the most exaggerated fullness should be placed. One, two, or more shaping points can be included to help force the material to bend at the preferred locations. This feature is particularly helpful if the garment is made from a stiff material. In embodiments, the depth of the shaping point can be varied from as little as 0.25 inches from the edge to a full 8 inches from the edge, with any depth in between. The further away the shaping point is from the edge, the more fullness is added the upper front torso. Also, including more shaping points adds more fullness to the shape.

Figure 15B:
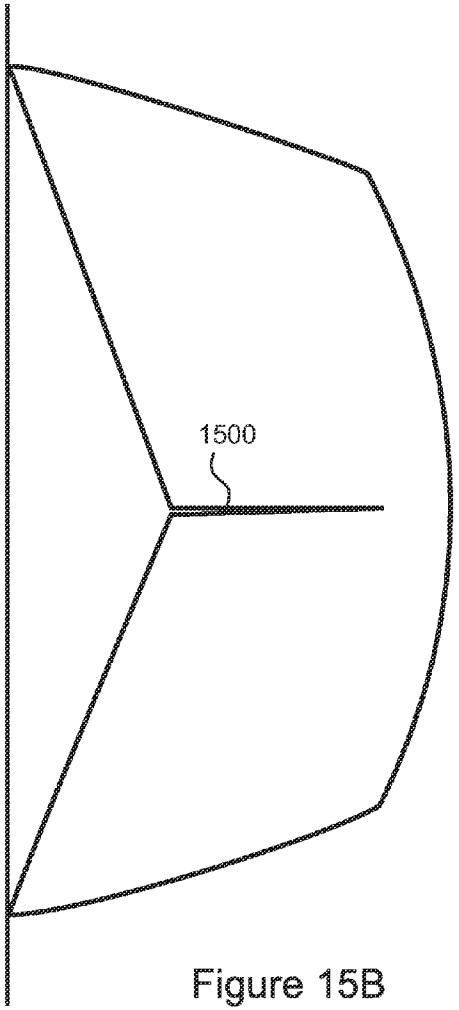
FIGS. 15A and 15B are images detailing the use of a slit to provide fullness in the garment.
Figure 15A:
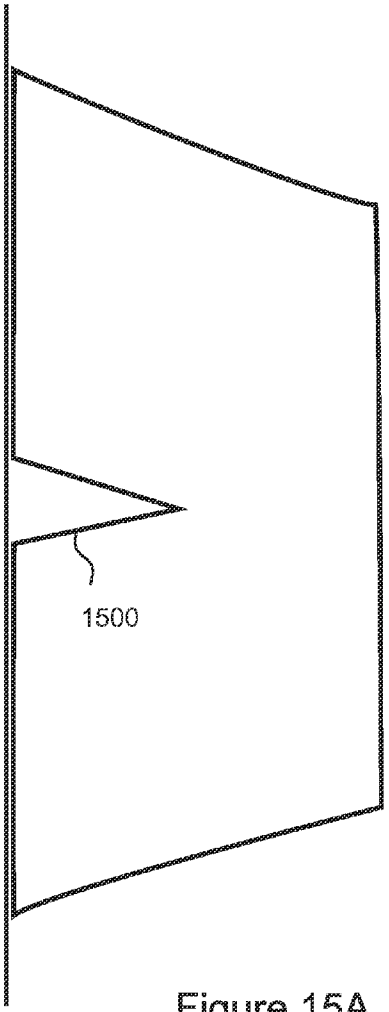

With reference to FIGS. 15A and 15B, still other embodiments of the garment include at least one substantially horizontal slit 1500 extending forward from each arm opening below or at arm level. This slit increases the fullness that can be provided by the garment. FIGS. 15 A and 15B illustrate an embodiment in which the slit is V-shaped. In the absence of shaping, as shown in FIG. 15A, the two sides of the slit 1500 remain spaced apart. As shown in FIG. 15B, to increase the shape, the two sides of the slit 1500 in the material can be brought closer together or overlapped. In this way the slit 1500 allows further shaping of the garment, which is particularly useful when the garment is made from a stiff material.

Figure 16B:
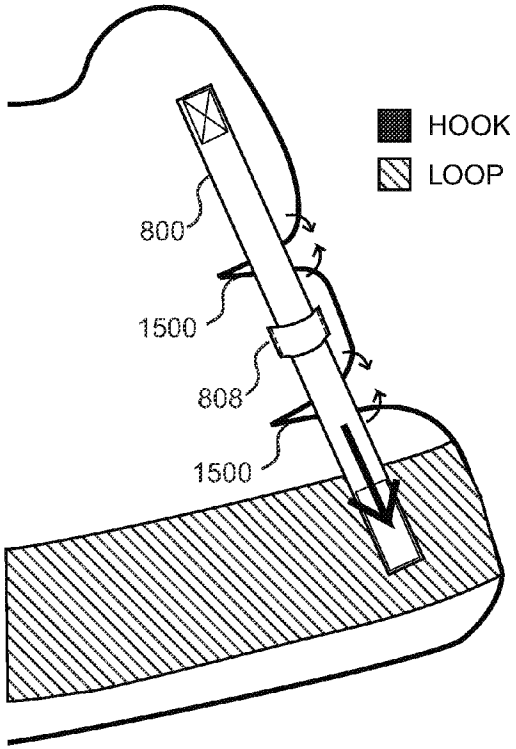
FIG. 16B is a side drawing of the embodiment of FIG. 16A, shown in a shaped configuration.
Figure 16A:
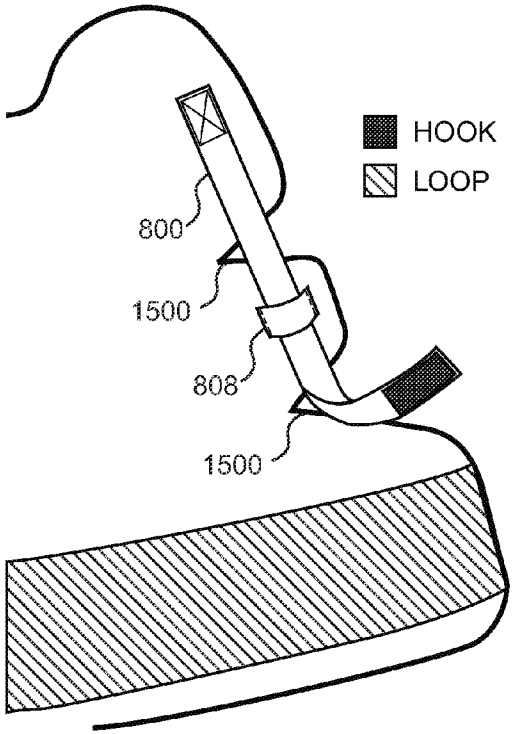
FIG. 16A is a side view of an embodiment in which a plurality of slits are adjusted using a single lanyard, shown in a substantially flat configuration.
Figure 16D:
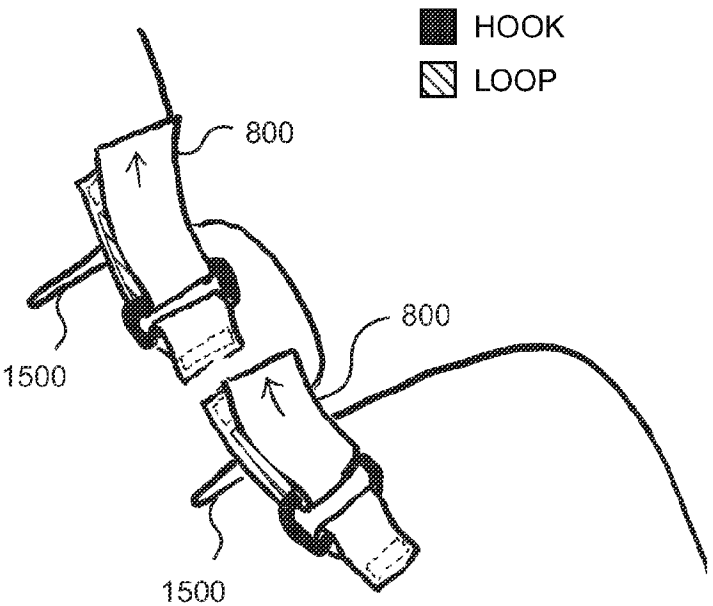
FIG. 16D is a side drawing of the embodiment of FIG. 16A, shown in a shaped configuration.
Figure 16C:
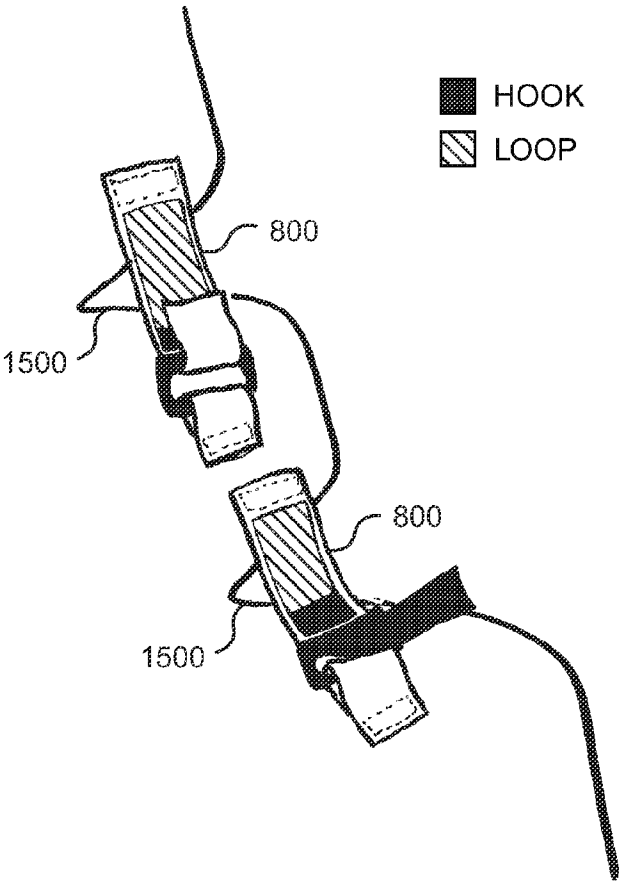
FIG. 16C is a side view of an embodiment in which a plurality of slits are each adjusted using a separate lanyard, shown in a substantially flat configuration.

One or multiple slits can be included to enhance the range of garment shaping, and the slits can have various locations along the outer edge of the garment from mid-shoulder to below the arm. With reference to FIGS. 16A and 16B, in some embodiments a plurality of slits 1500 can be adjusted using a singular lanyard 800. FIG. 16A illustrates such an embodiment in a substantially flat configuration, while FIG. 16B illustrates the same embodiment in a shaped configuration. In other embodiments, with reference to FIGS. 16C and 16D, each slit 1500 is paired with a separate lanyard 800 for adjustment. FIG. 16C illustrates such an embodiment in a substantially flat configuration, while FIG. 16D illustrates the same embodiment in a shaped configuration.

For garments with liners or other interior layers, in various embodiments slits are provided in the outer garment only, in the garment liner or interior layers only, or in any combination of the outer garment, the liner, and the interior layers. The range of available shaping, curving, and fullness is increased in these embodiments by the addition of the slits.

The present invention can apply shape to a garment that is otherwise without shape or three-dimensionality in the front upper torso. It can be added or retrofitted to traditional garments that have no shape, thereby allowing the modified garment to be adjusted for fullness in the upper front torso area. The present invention can also add adjustable shape to garments that already have some fullness in the front upper torso area, and thereby increase even further the garment's fullness. The invention can be also be added or retrofitted to traditional garments that have fullness.

With reference to FIG. 7, in embodiments the present invention allows the garment to be returned to a flat shape after shaping, which may be desirable to help with donning and removing the garment, when at rest, or when the garment is worn with other garments or accessories under circumstances where shaping or fullness are not desired. This ability to temporarily and reversibly adjust the fullness is another important feature of the invention in various embodiments.

In some embodiments, the shaping of the garment can be permanently locked once the right shape for the upper front torso is found for a particular user. In some circumstances, a user would prefer not to have to make adjustments to the garment each time it is donned and removed. By locking the shape adjustment of the garment, it can be ensured that the garment will have the same shape each time it is used. In some of these embodiments, by using a permanent adhesive, including but not limited to cement, pressure sensitive adhesives, or heat seals, the user can "freeze" the fullness to his or her preference.

In certain embodiments, the garment includes a lining or interior layer. In some of these embodiments, the lining or interior layer of the garment is adjusted with the outer garment. And in some of these embodiments, the fullness adjustment of the garment can force the interior layers and/or lining of the garment to take on the three-dimensional shape of the exterior garment. This can be helpful when the interior materials include fabrics such as silk or light synthetic that are delicate, and might be vulnerable to pulling and tearing. It can also be helpful to add shape to stiff lining and/or interior materials that are not easily shaped, such as flotation materials, sports equipment padding, or protective fabrics.

In some embodiments, some or all of the adjustable exterior of the garment is made from a protective material, while in other embodiments the garment is made entirely from one or more non-protective materials. In further embodiments, at least one interior layer or lining includes a protective material, while in other embodiments the interior layer or lining is made entirely from non-protective materials. A combination of all protective and some protective material can be included in the adjustable garment, depending on how much adjustment in fullness and how much protection is desired. For example, the present invention can be combined with the mosaic body armor described in co-pending U.S. patent application Ser. No. 13/082,442, which was invented by one of the co-inventors of the present invention.

In some embodiments, the inner-most layer of armor material is smaller than the outer-most layer of armor material, providing a garment that is self-shaping through patterns and sewing assemblies. By design, the smaller, inner layer serves as a pre-form to the outer layer, giving the outer layer a surface to curve around. In this way, the smaller, inner layer provides a three-dimensional shape to the outer layer when the two different sized layers are combined.

Example #1

Figure 1:
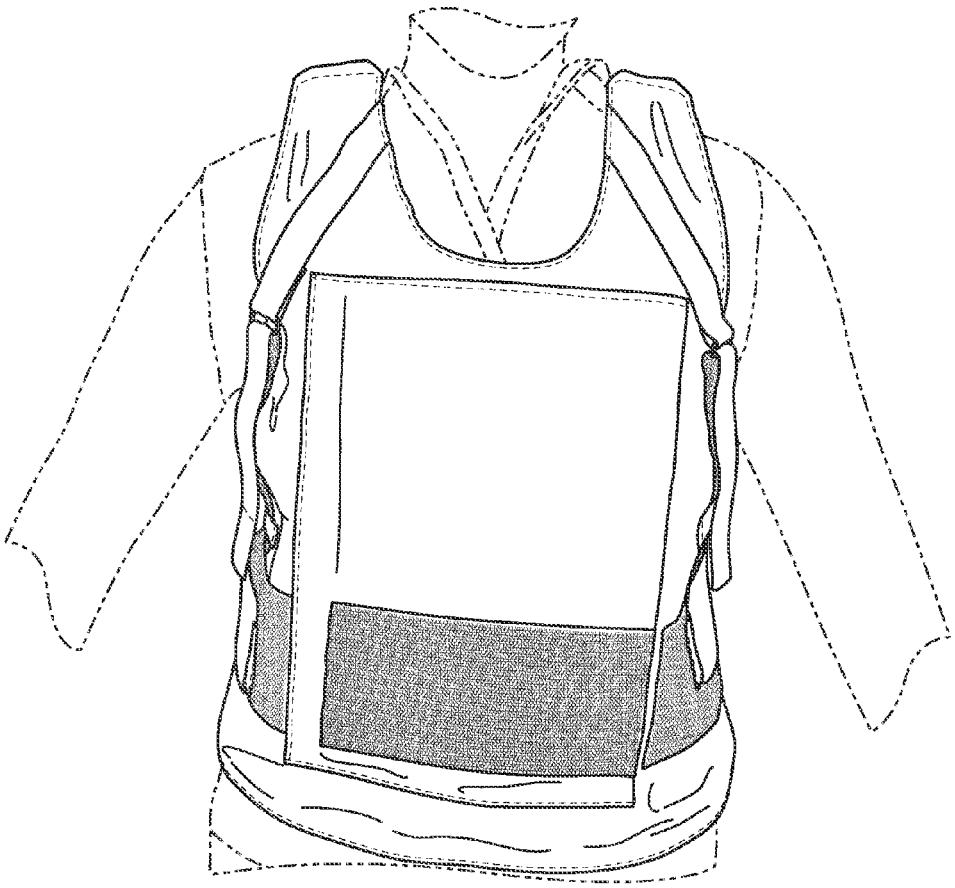
FIG. 1 is a front illustration of a user wearing an embodiment of the present invention shown in a nearly flat configuration.
Figure 2:
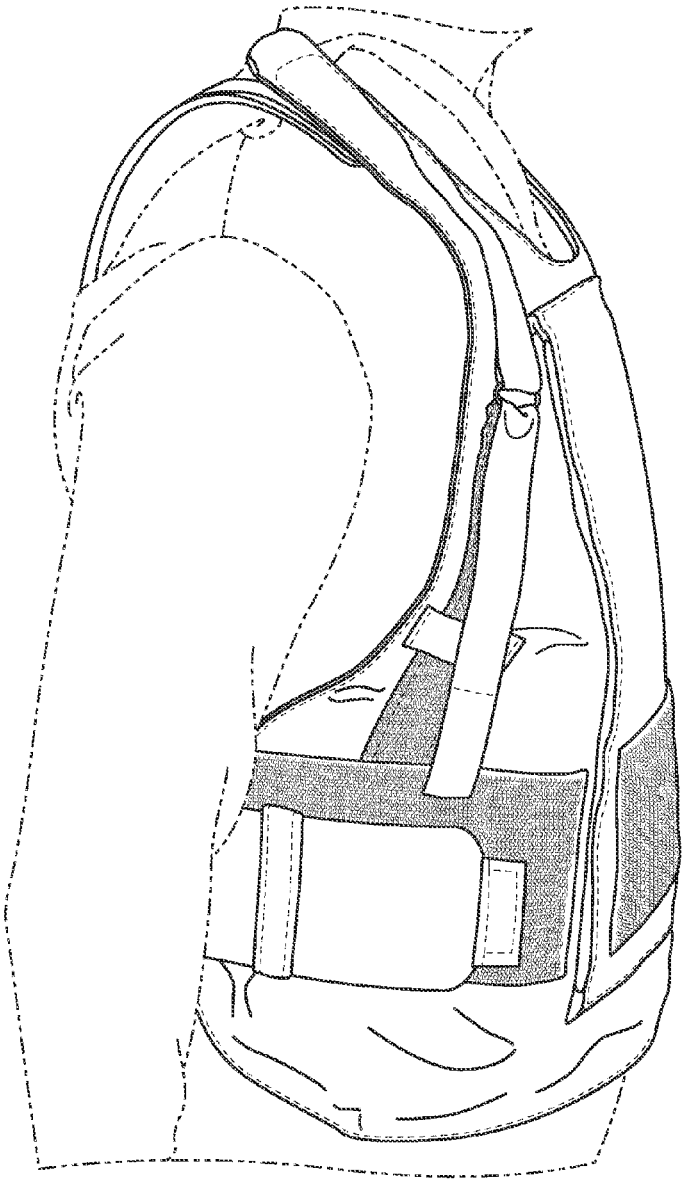
FIG. 2 is a side illustration of the embodiment of FIG. 1.
Figure 4:
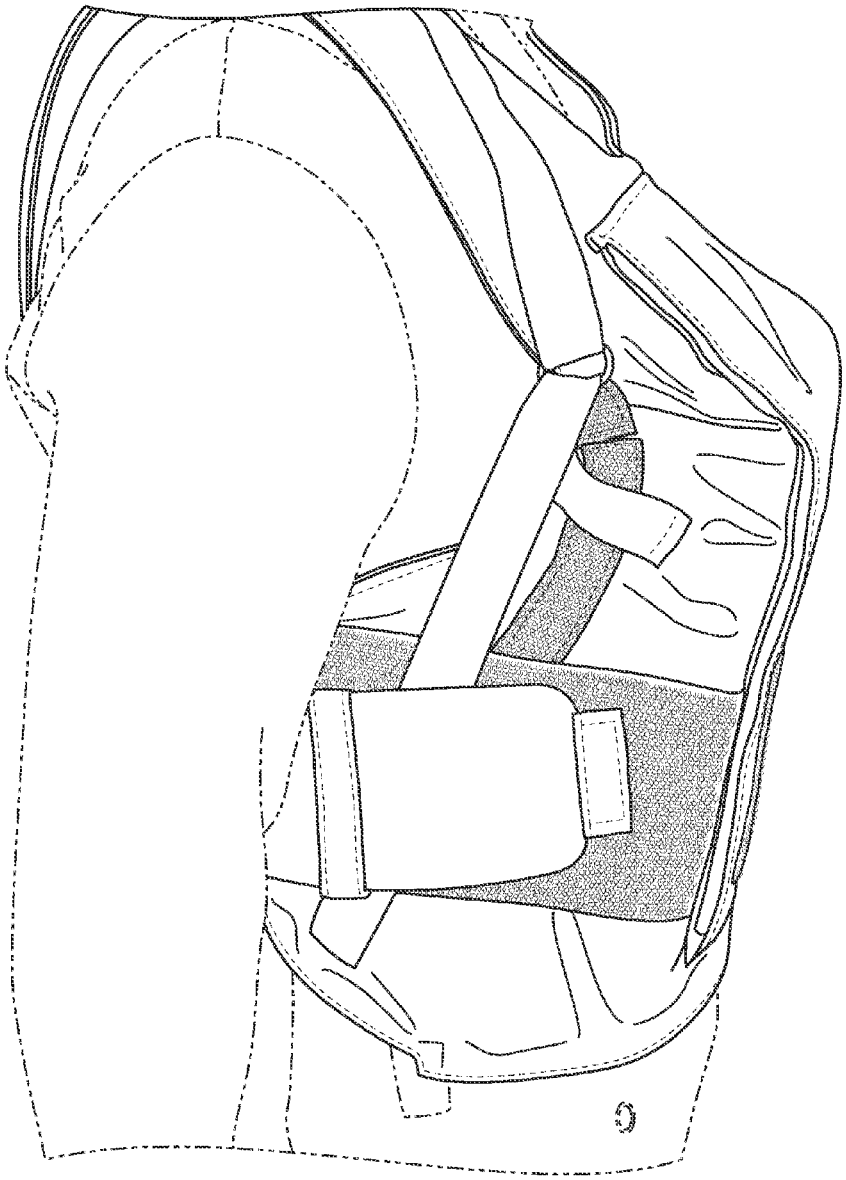
FIG. 4 is a side illustration of a user wearing an embodiment of the present invention shown in a full-figured configuration.
Figure 5:
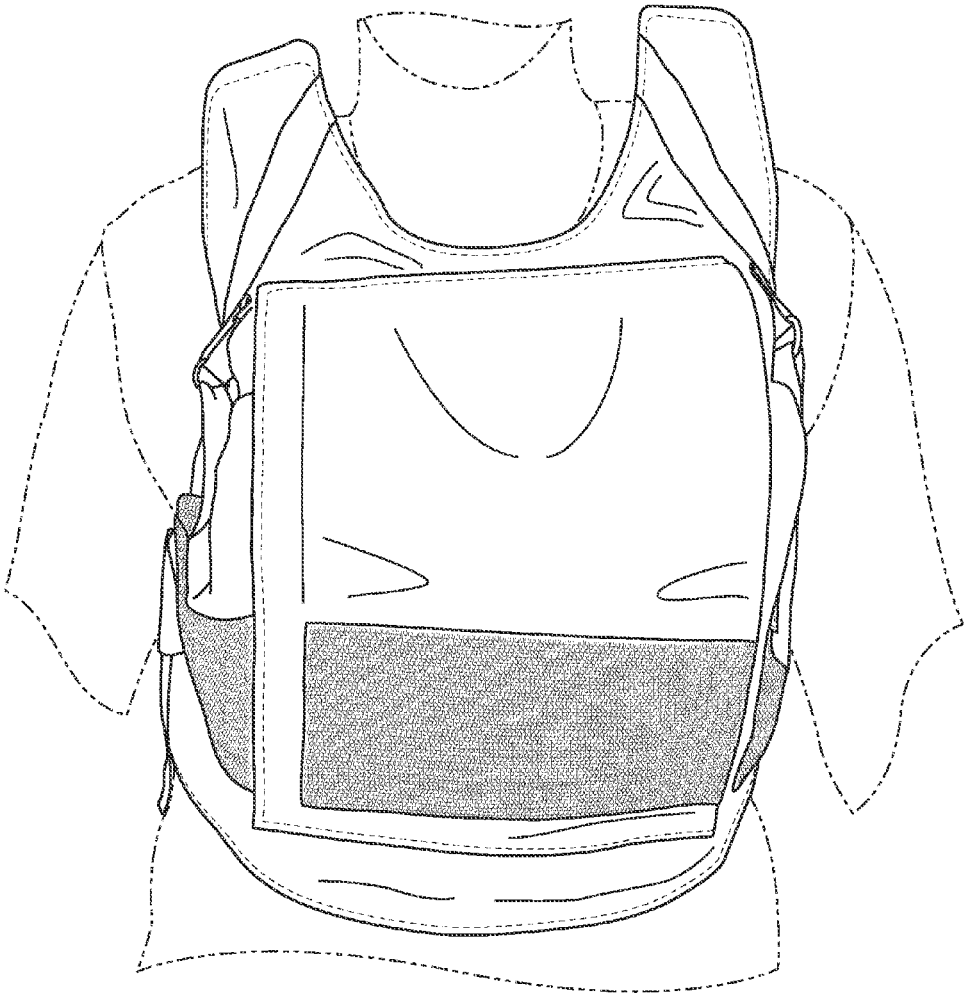
FIG. 5 is a front illustration of the embodiment of FIG. 4.
Figure 6:
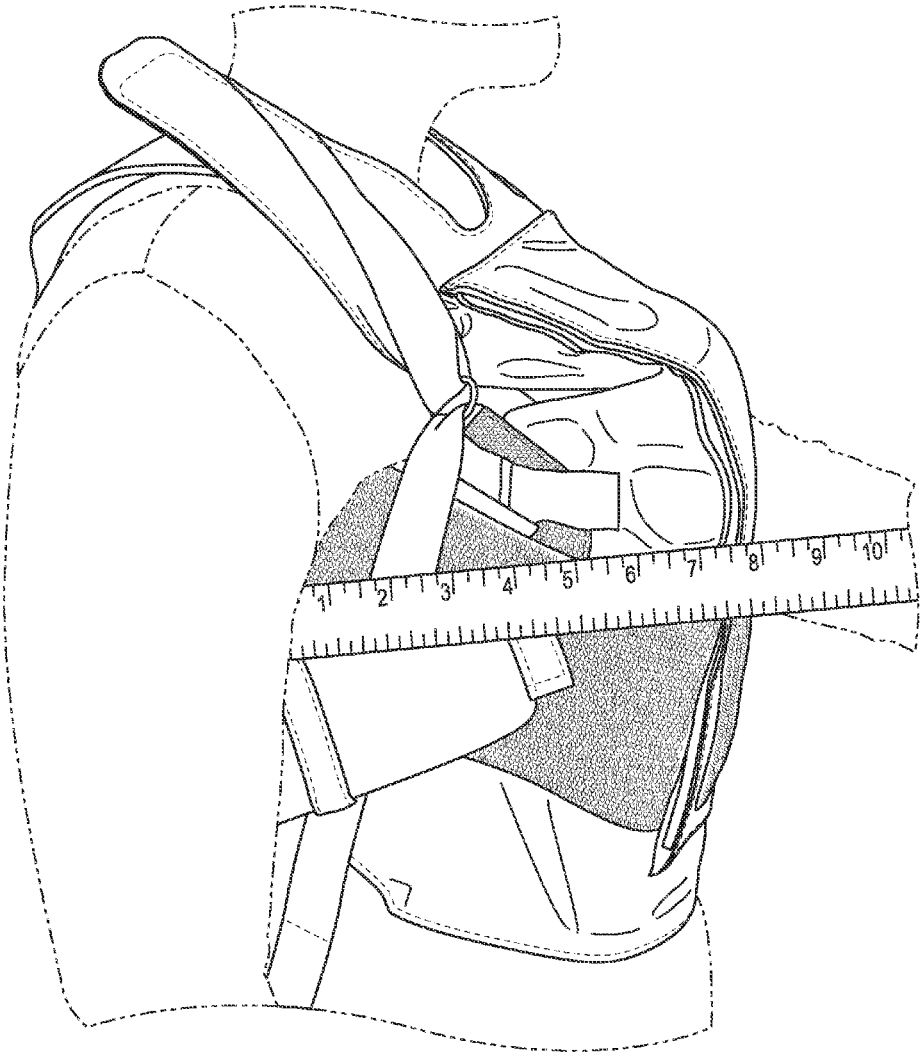
FIG. 6 is similar to FIG. 4, but includes a ruler showing a bust extension of approximately 8 inches from the back of the user.

See FIGS. 1 and 4

This embodiment uses an 8 oz/yd2, 500 denier textured nylon body armor carrier. The lanyard 800 is 17" long and ¾" wide. One end is permanently fixed to a band 806 that is attached to the front of the carrier below the bust. The other end of the lanyard 800 uses hook-and-loop fastening to the same band 806 for adjustment of the medium size garment. The lanyard top 802 is mounted at one end proximate to the anterior portion of the collar bone, running down the edge of the garment along the shoulder joint. In this example two shaping points 808 are included, which are sewn loops similar to belt loops. The lanyard top 802 terminates at its lower end in a polymeric D ring 804 through which the lanyard 800 smoothly runs for shape adjustment. In this example, the fullness ratio for a medium size garment is 1. The grading for size of the lanyard lengths, the sampling point spacing, and the top and bottom attachments use an average grading rule of 11% difference between sizes.

Example #2

Figure 17:
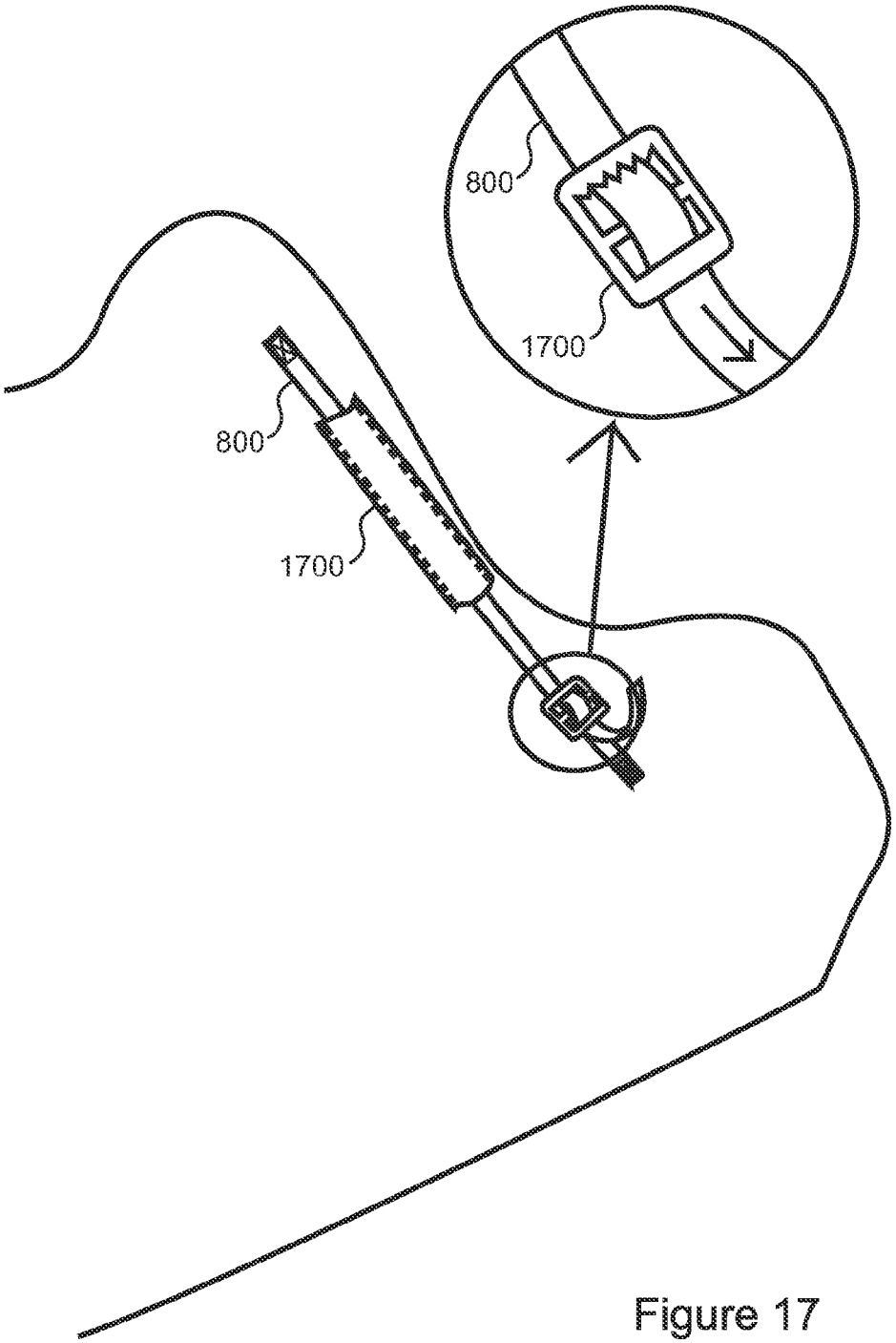
FIG. 17 is a drawing that illustrates a ¼" woven webbing and a top and bottom attachment point of an embodiment, wherein there is one 3" long shaping point that acts as a sheath for the lanyard, and wherein adjustment of the shape is controlled by a tooth-edge buckle.

With reference to FIG. 17, the embodiment in this example uses a 5 oz jersey knit of nylon with 5% spandex elastomeric fiber for stretch recovery. The outer edge of the garment is formed as a pocket 1700 to provide a cover for the lanyard system 800. The lanyard 800, shaping points 804 (not shown), and top and bottom attachments are all within the edge pocket 1700. The lanyard 800 used in this example is a ¼"×8" woven webbing made of nylon fiber for the medium size. In this example there is one 3" long shaping point 1700 that acts as a sheath for the lanyard, and the adjustment is controlled by a tooth edged buckle 1704. The top, bottom, and shape attachment points are made of woven nylon. The use of woven patch points spreads the lanyard forces out into the stretch knit and improves the evenness and smoothness of the shaped garment. In this example the fullness ratio is greater than 0.5.

Example #3

Figure 18:
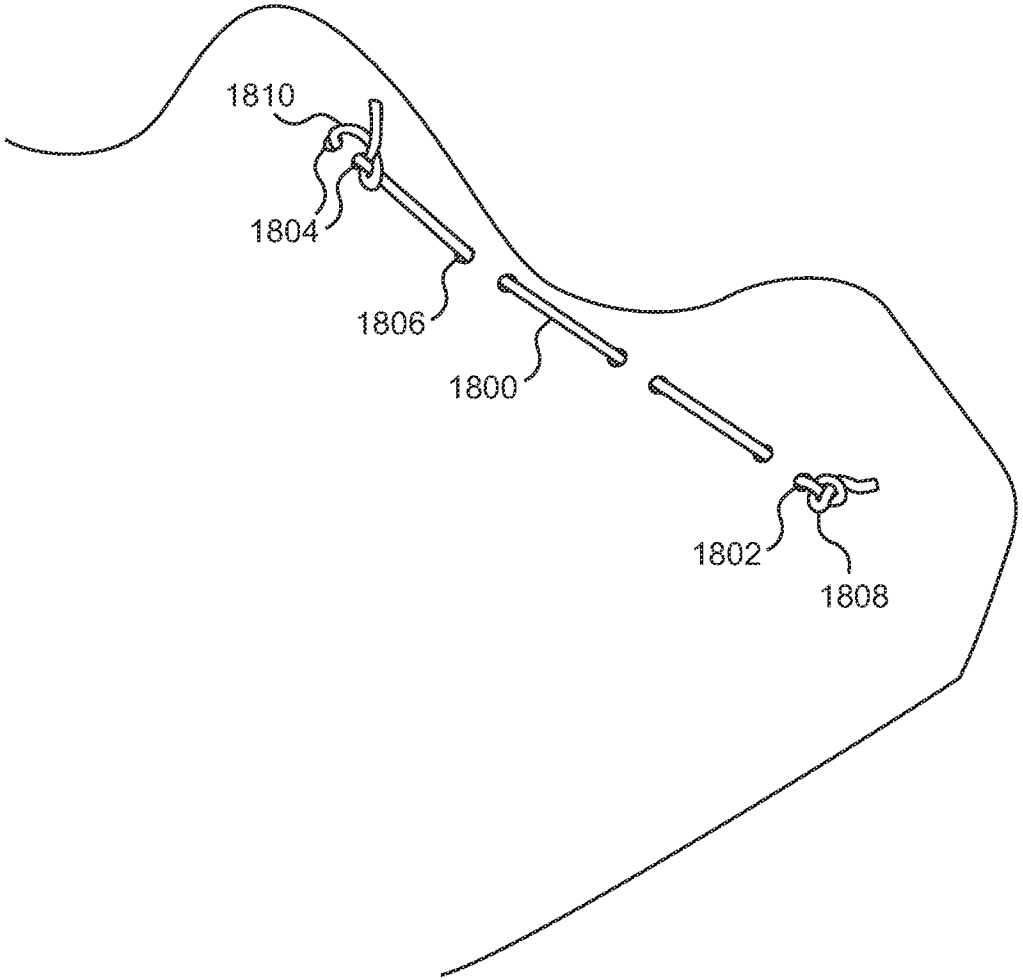
FIG. 18 is a drawing illustrating an embodiment in which the adjustment lanyard is a 3/16" diameter parachute cord, wherein the bottom and top mounting, as well as the shaping points, are round eyelet holes of 3/16" diameter, the bottom endpoint being formed by a stopper knot in the cord, the shaping points being paired eyelet holes, and the top adjustment point also being a set of eyelet holes, wherein the adjustments are fixed by simple half-hitch knots at the top eyelet holes.

With reference to FIG. 18, the embodiment in this example is manufactured from a 6 oz polyester-cotton woven material. The lanyard 800 used for the medium size garment is a 7" (3/16 meter) long nylon parachute cord 1800. The bottom 1802 and top 1804 mountings as well as the shaping points 1806 are round eyelet holes of 3/16 diameter. The bottom endpoint 1802 is formed by a stopper knot 1808 in the cord. The shaping points 1806 are paired eyelet holes, and the top adjustment point 1804 is also a pair of eyelet holes. The shape adjustment is fixed by adding a simple half hitch knot 1810 at the top eyelet holes. In the lanyard area, the woven is doubled to improve durability of the adjustment. In this example the fullness ratio is greater than 0.5

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

We claim:

1. A torso garment comprising:

an outer torso garment having two shoulders and a front section, said front section including an upper front torso region;

a controllable shape adjustment mechanism located in the upper front torso region of the outer torso garment, said shape adjustment mechanism being able to transition a shape of the outer torso garment from a substantially flat configuration to a three-dimensionally shaped configuration; and an inner layer included within the outer torso garment, wherein said inner layer is adjusted in shape together with the outer torso layer, wherein the outer torso garment further comprises inner pockets configured for holding and concealing body armor modules.

2. The torso garment of claim 1, further comprising an anterior garment edge comprising at least one shaping point.

3. The torso garment of claim 1, wherein the adjustment mechanism includes an adjustment lanyard having an attachment point proximal to a shoulder of the outer torso garment.

4. The torso garment of claim 3, wherein a lower attachment point of the adjustment lanyard can be moved in an anterior/posterior direction between a plurality of attachment locations on the outer torso garment.

5. The torso garment of claim 3, further comprising a shaping point attached to the outer torso garment, said shaping point being configured to require the adjustment lanyard apply force to a location that is cooperative with the shaping point.

6. The torso garment of claim 3, wherein the adjustment lanyard can be readjusted to transition the shape of the torso garment from the three-dimensionally shaped configuration into the substantially flat configuration.

7. The torso garment of claim 3, wherein the adjustment lanyard is located on an inwardly facing side of the outer torso garment.

8. The torso garment of claim 1, further comprising a locking mechanism that is able to inhibit changes to the shape of the outer torso garment.

9. The torso garment of claim 1, further comprising at least one slit extending along a portion of an anterior garment edge of the torso garment.

10. The torso garment of claim 1, wherein at least a portion of the torso garment comprises a material that is at least one of flame resistant and constructed from fibers that are greater than 15 gpd.

11. The torso garment of claim 1, wherein the torso garment has a three-dimensional shape arising from its pattern and sewing design.

12. A torso garment having a controllable shape adjustment that can be used to adjust a fullness of an upper front torso region of the torso garment, the torso garment comprising:

an outer torso garment having two shoulders and a front section, said front section including an upper front torso region; and a controllable shape adjustment mechanism located in the upper front torso region of the outer torso garment, said shape adjustment mechanism being able to transition a shape of the outer torso garment from a substantially flat configuration to a three-dimensionally shaped configuration having a fullness ratio of greater than 0.1 in the torso when measured along a sagittal mid-plane of the outer torso garment, said shaping mechanism comprising an adjustment lanyard, wherein the outer torso garment further comprises inner pockets configured for holding and concealing body armor modules.

13. The torso garment of claim 12, wherein the adjustment lanyard includes at least one attachment point proximal to a shoulder of the outer torso garment.

14. The torso garment of claim 12, further comprising an anterior garment edge comprising at least one shaping point.

15. The torso garment of claim 12, wherein the adjustment mechanism is able to transition the shape of the outer torso garment to a three-dimensionally shaped configuration having a fullness ratio of greater than 0.5 in the torso when measured along a sagittal mid-plane of the outer torso garment.

16. The torso garment of claim 12, wherein a lower attachment point of the adjustment lanyard can be moved in an anterior/interior direction between a plurality of attachment locations on the outer torso garment.

17. The torso garment of claim 12, wherein the adjustment lanyard is located on an inwardly facing side of the outer torso garment.

18. The torso garment of claim 12, further comprising a locking mechanism that is able to inhibit changes to the shape of the outer torso garment.

19. The torso garment of claim 12, wherein the adjustment lanyard can be readjusted to transition the shape of the torso garment from the three-dimensionally shaped configuration into the substantially flat configuration.

20. The torso garment of claim 12, further comprising at least one slit extending along a portion of an anterior garment edge of the torso garment.

21. The torso garment of claim 12, wherein at least a portion of the torso garment comprises a material that is at least one of flame resistant and constructed from fibers that are greater than 15 gpd.

22. The torso garment of claim 12, wherein the torso garment has a three-dimensional shape arising from its pattern and sewing design.

23. A method for adjusting a shape of a torso garment, the method comprising:

providing a torso garment; and using an adjustment mechanism to transition a shape of the torso garment from a substantially flat configuration to a three dimensional shaped configuration by applying a force to at least two adjustment locations on the torso garment, said two adjustment locations being selected from the group of locations including a first location proximal to an anterior armpit of the outer torso garment, a second location proximal to a midpoint frontal plane of the torso garment and to an under bust girth of the torso garment, and a third location located between the first location and the second location, wherein the outer torso garment further comprises inner pockets configured for holding and concealing body armor modules.

24. The method of claim 23, wherein the torso garment comprises an anterior garment edge that includes at least one shaping point.

25. The method of claim 23, wherein the adjustment mechanism includes an adjustment lanyard having an attachment point proximal to a shoulder of the torso garment.

26. The method of claim 25, wherein a lower attachment point of the adjustment lanyard can be moved in an anterior/posterior direction between a plurality of attachment locations on the torso garment.

27. The method of claim 25, further comprising using a locking mechanism to inhibit changes to the shape of the outer torso garment.

28. The method of claim 25, wherein the adjustment lanyard is located on an inwardly facing side of the torso garment.

29. The method of claim 25, further comprising readjusting the adjustment lanyard to transition the shape of the torso garment from the three-dimensionally shaped configuration to the substantially flat configuration.

30. The method of claim 25, wherein the torso garment further comprises a shaping point attached thereto, said shaping point being configured to require the adjustment lanyard to apply force to a location that is cooperative with the shaping point.

31. The method of claim 23, wherein the torso garment further comprises at least one slit extending along a portion of an anterior garment edge of the torso garment.

32. The method of claim 23, wherein at least a portion of the torso garment comprises a material that is at least one of flame resistant and constructed from fibers that are greater than 15 gpd.

33. The method of claim 23, wherein the torso garment has a three-dimensional shape arising from its pattern and sewing design.

* * * * *